US007936236B2

(12) United States Patent
Kim et al.

(10) Patent No.: US 7,936,236 B2
(45) Date of Patent: May 3, 2011

(54) SWITCHABLE COMBINER/DIVIDER WITH MULTIPLE INPUTS/OUTPUTS

(75) Inventors: Taek-Dong Kim, Gyeonggi-do (KR); Duk-Yong Kim, Gyeonggi-do (KR); Jung-Pil Lee, Gyeonggi-do (KR); Sang-Sig Park, Gyeonggi-do (KR); Jin-Chul Hwang, Gyeonggi-do (KR); Nam-Shin Park, Gyeonggi-do (KR)

(73) Assignee: KMW Inc. (KR)

( * ) Notice: Subject to any disclaimer, the term of this patent is extended or adjusted under 35 U.S.C. 154(b) by 229 days.

(21) Appl. No.: 12/442,039

(22) PCT Filed: Dec. 7, 2006

(86) PCT No.: PCT/KR2006/005278

§ 371 (c)(1),
(2), (4) Date: Mar. 19, 2009

(87) PCT Pub. No.: WO2008/035834

PCT Pub. Date: Mar. 27, 2008

(65) Prior Publication Data

US 2010/0019860 A1 Jan. 28, 2010

(30) Foreign Application Priority Data

Sep. 21, 2006 (KR) ..... 10-2006-0091944
Nov. 3, 2006 (KR) ..... 10-2006-0108593

(51) Int. Cl.
*H01P 1/10* (2006.01)
*H01P 5/12* (2006.01)

(52) U.S. Cl. ..... 333/101; 333/107

(58) Field of Classification Search ..... 333/101, 333/103, 104, 105, 106, 107, 262
See application file for complete search history.

(56) References Cited

U.S. PATENT DOCUMENTS 4,302,734 A 11/1981 Frosch et al.
5,510,757 A * 4/1996 Kumar et al. ..... 333/104
5,872,491 A 2/1999 Kim et al.
6,677,688 B2 * 1/2004 Freeston et al. ..... 307/113

FOREIGN PATENT DOCUMENTS

KR 10-2004-0016694 A 2/2004

* cited by examiner

*Primary Examiner* — Dean O Takaoka
(74) *Attorney, Agent, or Firm* — Storm LLP

(57) ABSTRACT

A switchable combiner/divider with multiple inputs/outputs is provided. The switchable combiner/divider with multiple inputs/outputs includes multiple input ports for receiving multiple incoming signals, multiple output ports, a switching part for alternately connecting the multiple input ports to output ports as a circulating configuration, and a controller for providing switching control signals to the switching part.

20 Claims, 8 Drawing Sheets

SWITCHABLE COMBINER/DIVIDER WITH MULTIPLE INPUTS/OUTPUTS

TECHNICAL FIELD

The present invention relates to a combiner/divider, and more specifically, to a switchable combiner/divider with M inputs and N outputs.

BACKGROUND ART

A mobile communication service provider acquires a frequency band to provide a service and then divides the acquired frequency band to partial frequency bands (Frequency Assignment, FA).

In addition, a service area is configured as an OMNI cell or a sector-divided one according to the type of the service area and the number of subscribers.

The partial FAs are allocated to sectors. Usually, fixed multiple FAs are allocated to cover up a maximum call rate in each sector.

For example, if one sector requires up to 3 FAs, a total of 9 FAs are required in a base station and some components, units, and equipments are needed to process the 9 FAs.

By the way, the probability of an occurrence of maximum calls in each of the 3 sectors simultaneously is very low. Therefore, a service provider normally assigns 2 FAs to each sector and then may assign one FA, coming from a near sector with a low call rate, to a sector requiring 3 FAs. If they can assign FAs dynamically, a base station is able to run with a small number of FAs (6 FAs) totally, not initially having with 9 FAs.

If 9FAs and related equipments are already installed, the operation efficiency of the base station will be improved by increasing the maximum number of allocable FAs from 3 FAs to 4 FAs in a sector.

However, because a fixed N:1 combiner or a fixed 1:N divider, and several switches are used in an existing technology, this connection structure is complicated. As a consequence, a big insertion loss and cost are drawbacks, if ever implemented.

DISCLOSURE OF INVENTION

Technical Problem

An object of the present invention is to provide a M:N switchable combiner that receives M incoming signals and then combines the incoming signals into N outgoing signals, and a reciprocal N: M switchable divider that receives N incoming signals and then combines the incoming signals into M outgoing signals to solve the afore-mentioned issues.

Another object of the present invention is to provide a switchable combiner/divider with multiple inputs/outputs to set the output direction of incoming signals dynamically.

A further object of the present invention is to provide a switchable combiner/divider with multiple inputs/outputs to reduce switch connection points and the number of cables needed, compared to the case where multiple switches, combiners and dividers are connected by cables.

Still another object of the present invention is to provide a switchable combiner/divider with multiple inputs/outputs to send out signals without disconnection by using a replaceable redundancy port in case of a failure at an input port.

Yet another object of the present invention is to provide a switchable combiner/divider with multiple inputs/outputs to supplement n incoming signals.

Technical Solution

To accomplish the above mentioned objects, the present invention comprises multiple input ports for receiving multiple incoming signals, multiple output ports, a switching part for alternately connecting the multiple input ports to the multiple output ports as a circulating configuration, and a controller for providing switching control signals to the switching part.

Advantageous Effects

A switchable combiner/divider with multiple inputs/outputs according to the present invention sets the direction of output selectively depending on the switching status, in the case where it receives M incoming signals and then sends out N outgoing signals by combining and dividing them.

Also, the switchable combine/divider with multiple inputs/outputs is simple in structure, has less loss, and is small in size because of no unnecessary transmission line between ports.

Furthermore, the switchable combine/divider with multiple inputs/outputs can expand the number of incoming/outgoing signals to N.

The switchable combine/divider with multiple inputs/outputs prevents the disconnection of signal transmission by using a redundancy port, in case any input port is failed.

MODE FOR THE INVENTION

A preferred embodiment of the present invention will be described in detail with the accompanied drawings.

Figure 1:
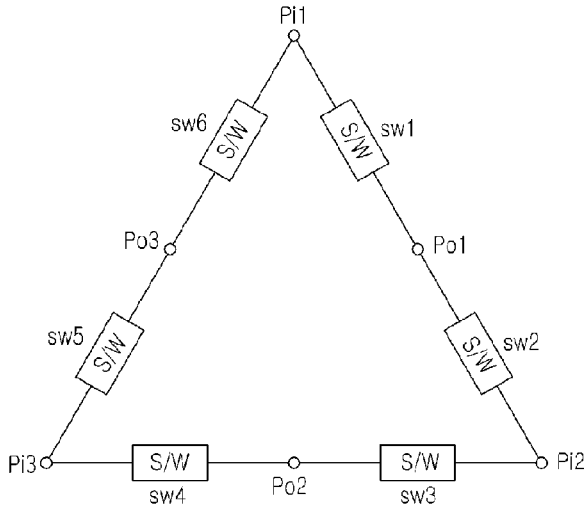
FIG. 1 depicts a schematic diagram according to an embodiment of the present invention.

FIG. 1 depicts a schematic diagram according to an embodiment of the present invention. As illustrated, it comprises 3 input ports (Pi1, Pi2, Pi3) for 3 incoming signals, 3 output ports (Po1, Po2, Po3), and 6 switches (sw1~sw6) that alternatively connect the 3 input ports to the 3 output ports as a circulating configuration.

The switches (sw1~sw6) are controlled by the switching control signals of a controller (not shown).

An operation will be described with reference to FIG. 2.

Figure 2:
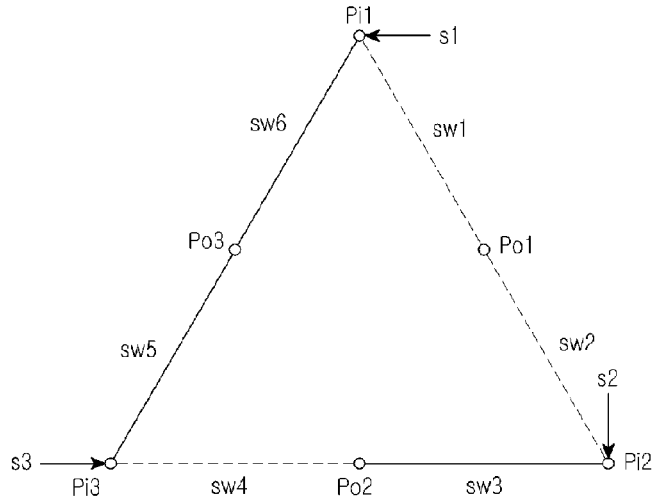
FIG. 2 depicts a switching status diagram of FIG. 1.

FIG. 2 depicts the case that $1^{st}$ and $3^{rd}$ incoming signals (s1, s3) at the $1^{st}$ and $3^{rd}$ input ports (Pi1, Pi3) are to be sent out into the $3^{rd}$ output port (Po3), and a $2^{nd}$ incoming signal (s2) at the $2^{nd}$ input port (Pi2) is to be sent out into the $2^{nd}$ output port (Po2).

The $1^{st}$, $2^{nd}$ and $4^{th}$ switches (sw1, sw2 and sw4) are off and the $3^{rd}$, $5^{th}$ and $6^{th}$ (sw3, sw5 and sw6) switches are on. Then the incoming signal (s1) coming from the $1^{st}$ input port (Pi1) and the incoming signal (s3) coming from the $3^{rd}$ input port (Pi3) are combined and are sent out into the $3^{rd}$ output port (Po3), and the incoming signal (s2) coming from the $2^{nd}$ input port (Pi2) is sent out into the $2^{rd}$ output port (Po2).

According to the above first embodiment, a 3:3 switchable combiner receives 3 incoming signals from 3 input ports and sends out them into 3 output ports, and more is able to set the output direction of the incoming signals selectively depends on the status of switches therein.

In addition, the switchable combiner runs as one with more incoming signals than outgoing signals when incoming signals are supplemented.

Figure 3:
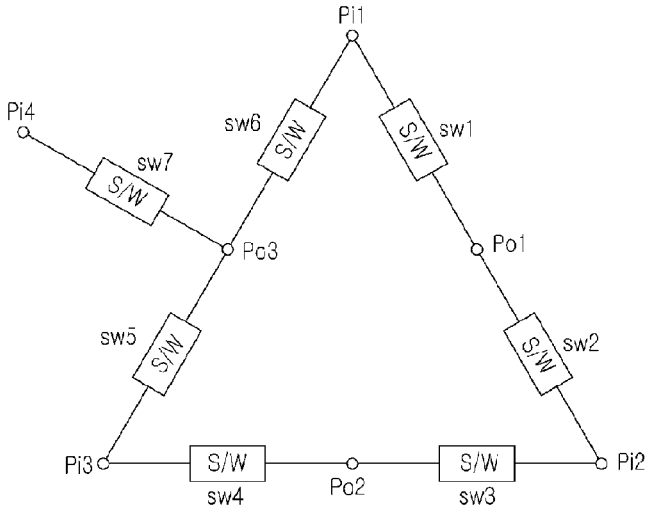
FIG. 3 illustrates a schematic diagram supplemented with one input port.

As illustrated in FIG. 3, a 4:3 switchable combiner has a $4^{th}$ input port (Pi4). When a $7^{th}$ switch connects the $3^{rd}$ output port (Po3) to the $4^{th}$ input port (Pi4), the 4:3 switchable combiner receives 4 incoming signals and then sends out 3 outgoing signals.

Herein, the $3^{rd}$ output port (Po3) combines a maximum of 3 incoming signals.

Figure 4:
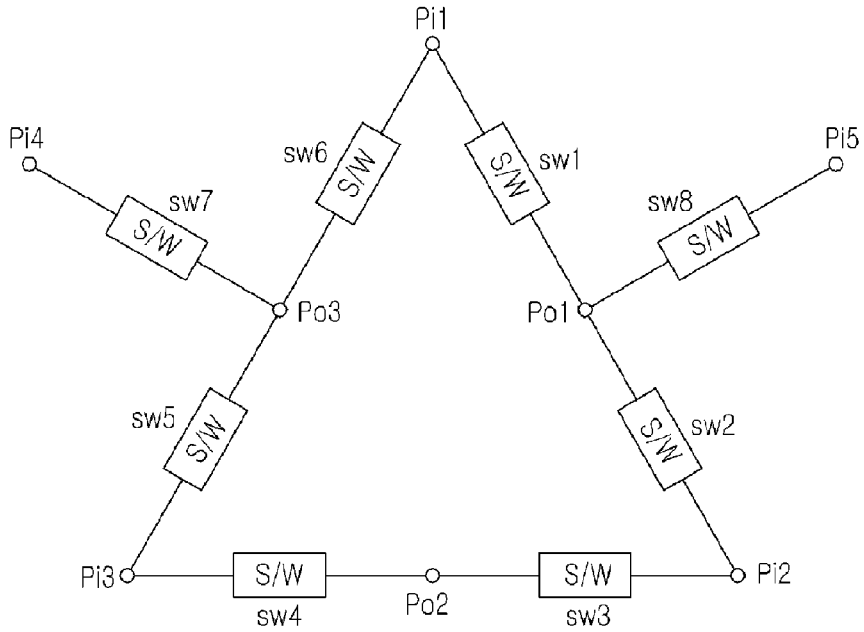
FIG. 4 illustrates a schematic diagram supplemented with two input ports.

As illustrated in FIG. 4, a $5^{th}$ input port (Pi5) is added to the structure of FIG. 3. When an $8^{th}$ switch connects the $1^{st}$ output port (Po1) to a $5^{th}$ input port (Pi5), a 5:3 switchable combiner receives 5 incoming signals and then sends out 3 outgoing signals.

Herein, the $1^{st}$ and $3^{rd}$ output ports each combine a maximum of 3 incoming signals.

Figure 5:
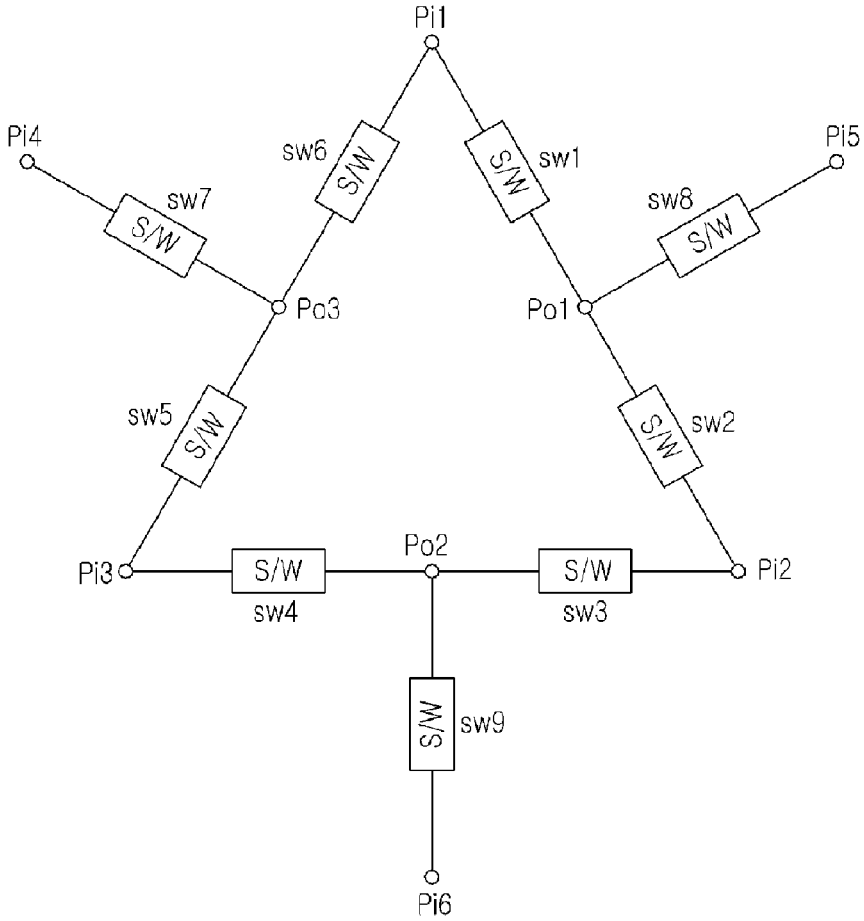
FIG. 5 illustrates a schematic diagram supplemented with three input ports.

As illustrated in FIG. 5, a $6^{th}$ input port (Pi6) is added to the structure of FIG. 4. When a $9^{th}$ switch connects the $2^{nd}$ output port (Po2) to the $6^{th}$ input port (Pi6), a 6:3 switchable combiner receives 6 incoming signals and then sends out 3 outgoing signals.

Each of the $1^{st}$, $2^{nd}$ and $3^{rd}$ output ports combines a maximum of 3 input signals.

Figure 6:
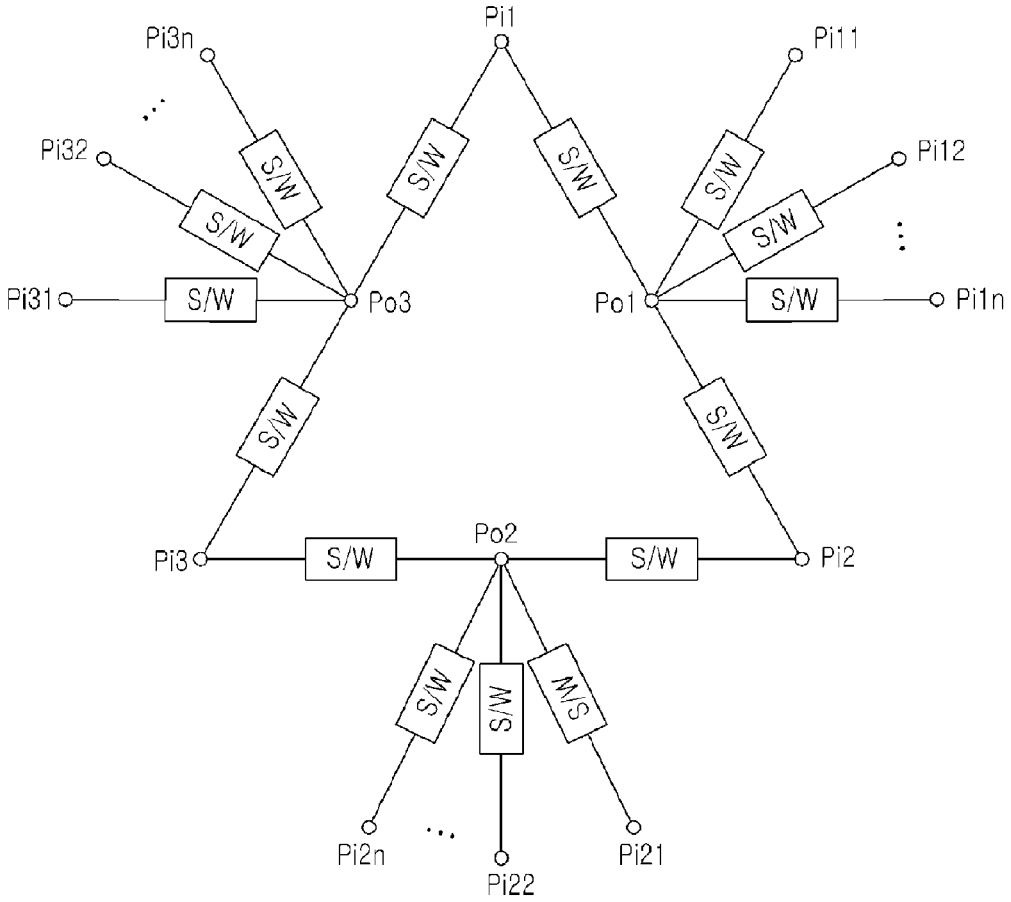
FIG. 6 illustrates a schematic diagram supplemented with N input ports.

Up to N input ports can be supplemented at each input port as illustrated in FIG. 6.

Figure 7:
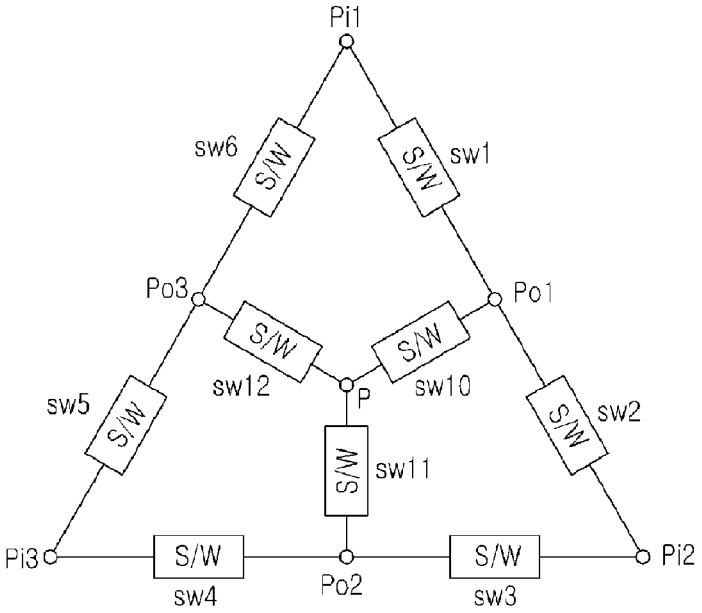
FIG. 7 is a schematic diagram depicts the connection status of a redundancy port according to another embodiment of the present invention.

FIG. 7 depicts a schematic diagram according to another embodiment of the present invention. As illustrated, it comprises 3 input ports (Pi1, Pi2, Pi3) for receiving 3 incoming signals, 3 output ports (Po1, Po2, Po3), 6 switches (sw1~sw6) for alternately connecting the 3 input ports to the 3 output ports as a circulating configuration, a redundancy port (P), and switches (sw10, sw11, and sw12) for connecting the redundancy port (P) to the output ports (Po1, Po2 and Po3).

The switches are controlled by the switching control signals of a controller (not shown).

An operation will be described below.

In normal operation, the switches (sw10, sw11, and sw12) are always off.

In case of a failure at any of the input ports (Pi1, Pi2, and Pi3), the redundancy port (P) replaces the failed input port.

Specifically, when incoming signals (s1, s3) at the $1^{st}$ and $3^{rd}$ input ports (Pi1, Pi3) are to be sent out into the $3^{rd}$ output port (Po3), and an incoming signal (s2) at the $2^{nd}$ input port (Pi2) is to be sent out into the $2^{nd}$ output port (Po2), the $1^{st}$ input port fails, for example.

The $1^{st}$, $2^{nd}$, $4^{th}$ and $6^{th}$ switches (sw1, sw2, sw4, and sw6) are off and the $3^{rd}$, $5^{th}$ and $12^{th}$ switches (sw3, sw5, and sw12) are on. Therefore, the $1^{st}$ incoming signal (s1) coming from the redundancy port (P), not from the $1^{st}$ input port (Pi1) is sent out into the $3^{rd}$ output port (Po3). In addition, the $2^{rd}$ incoming signal (s2) coming from the $2^{rd}$ input port (Si2) is sent out into the $2^{nd}$ output port (Po2).

In accordance with the second embodiment of the present invention, in case of a failure of any of the input ports, the disconnection of incoming signals is prevented by replacing the failed input port with the redundancy port.

Meanwhile, the above redundancy port is not limited to the usage of replacement of the failed input port. It can be used as an input port for a supplemented signal.

Figure 8:
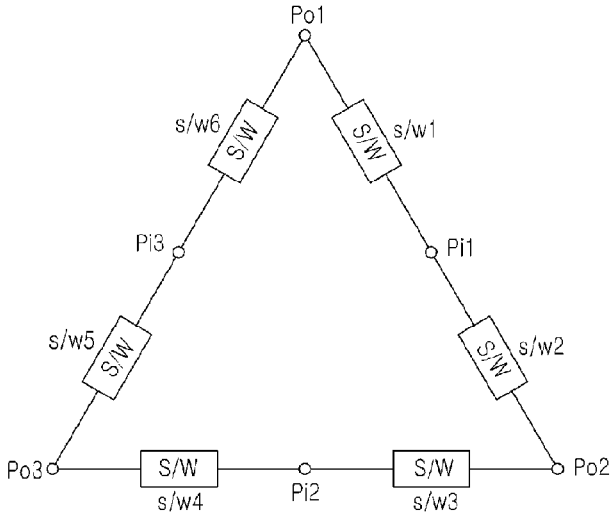
FIG. 8 depicts a schematic diagram according to a third embodiment of the present invention.

FIG. 8 depicts a circuit diagram according to a third embodiment of the present invention. As illustrated, it comprises 3 input ports (Pi1, Pi2, Pi3) for receiving incoming signals, 3 output ports (Po1, Po2, Po3), and 6 switches (sw1~sw6) for alternately connecting the 3 input ports to the 3 output ports as a circulating configuration.

The switches (sw1~sw6) are controlled by switching control signals of a controller (not shown).

An operation will be described with reference to FIG. 9.

Figure 9:
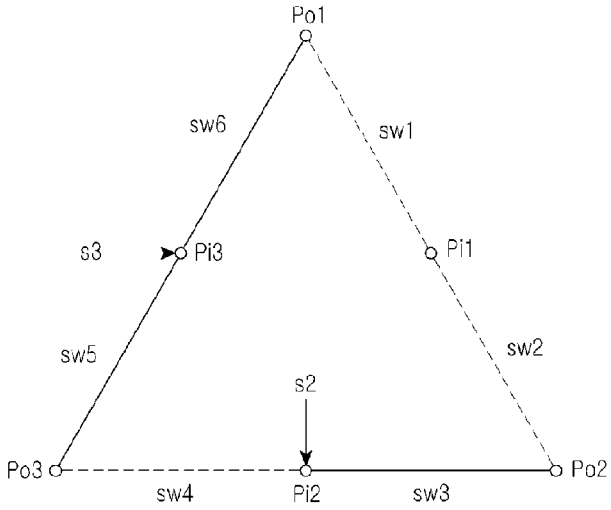
FIG. 9 depicts a switching status diagram of FIG. 8.

FIG. 9 depicts the case that a $3^{rd}$ incoming signal (s3) at the $3^{rd}$ input port (Pi3) is to be divided and sent out into the $1^{st}$ and $3^{rd}$ output ports (Po1, Po3) and a $2^{nd}$ incoming signal (s2) at the $2^{nd}$ input port (Pi2) is to be sent out into the $2^{nd}$ output port (Po2), for example.

The $1^{st}$, $2^{nd}$ and $4^{th}$ switches (sw1, sw2 and sw4) are off and the $3^{rd}$, $5^{th}$ and $6^{th}$ (sw3, sw5 and sw6) switches are on.

Then the $3^{rd}$ incoming signal (s3) coming from the $3^{rd}$ input port (Pi3) is divided and sent out into the $1^{st}$ and $3^{rd}$ output ports (Po1, Po3), and the $2^{nd}$ incoming signal (s2) at the $2^{nd}$ input port (Pi2) is sent out into the $2^{rd}$ output port (Po2).

According to the above third embodiment, a 3:3 switchable divider receives 3 incoming signals from 3 input ports and sends out them into 3 output ports. It can characteristically set the output direction of the incoming signals selectively depending on the status of the switches. In addition, the divider divides the incoming signals and sends out them into 2 output ports.

When output ports are supplemented at the input ports, the divider runs as an M (input): N (output) switchable divider.

Figure 10:
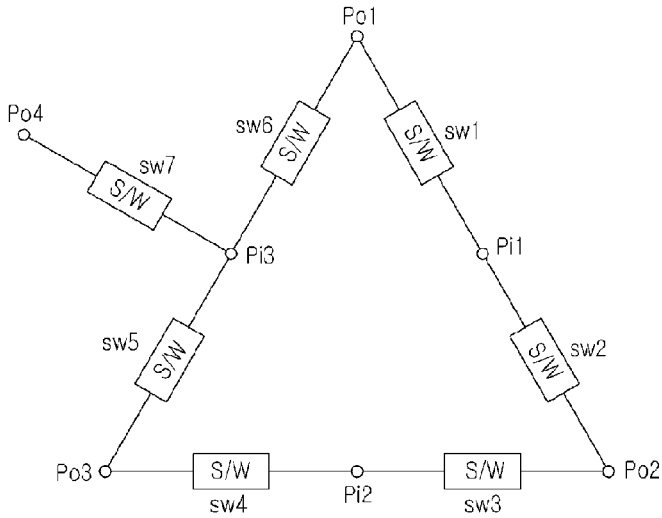
FIG. 10 illustrates a schematic diagram supplemented with one output port.

As illustrated in FIG. 10, a $4^{th}$ output port (Po4) is provided. When a $7^{th}$ switch connects the $3^{rd}$ input port (Pi3) to a $4^{th}$ output port (Po4), a 3:4 switchable divider receives 3 incoming signals from 3 input ports and sends out them into 4 output port.

Herein the $3^{rd}$ input port (Pi3) divides the incoming signal into a maximum of 3 outgoing signals.

Figure 11:
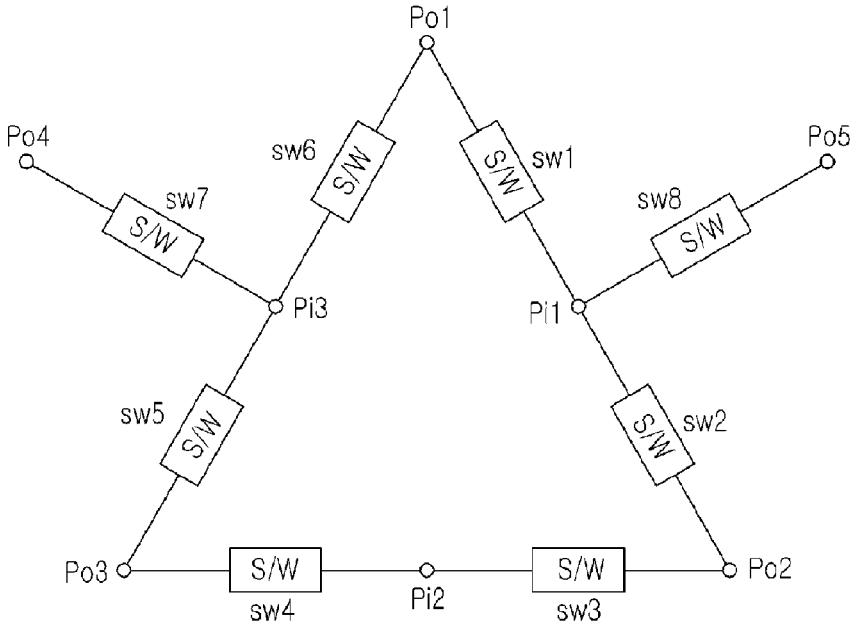
FIG. 11 illustrates a schematic diagram supplemented with two output ports.

As illustrated in FIG. 11, a $5^{th}$ output port (Po5) is added to the structure of FIG. 10. When a $8^{th}$ switch connects a $1^{st}$ input port (Pi1) to the $5^{th}$ output port (Po5), a 3:5 switchable divider receives 3 incoming signals from 3 input ports and sends out them into 5 output ports.

Herein each of the $1^{st}$ and $3^{rd}$ input ports divides the incoming signal into a maximum of 3 outgoing signals.

Figure 12:
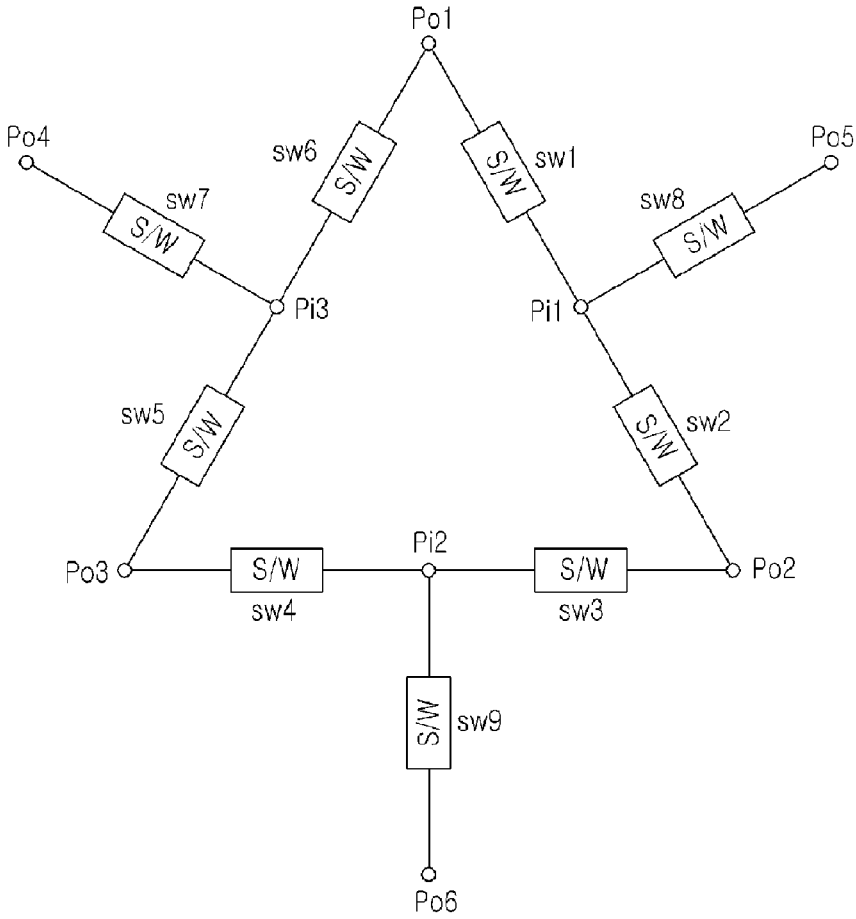
FIG. 12 illustrates a schematic diagram supplemented with three output ports.

As illustrated in FIG. 12, a $6^{th}$ output port (Po6) is added to the structure of FIG. 11. When a $9^{th}$ switch connects a $2^{nd}$ input port (Pi2) to a $6^{th}$ output port (Po6), a 3:6 switchable divider receives 3 incoming signals from 3 input ports and sends out them into 6 output ports.

Herein each of the $1^{st}$, $2^{nd}$ and $3^{rd}$ input ports divides the incoming signal into a maximum of 3 outgoing signals.

Figure 13:
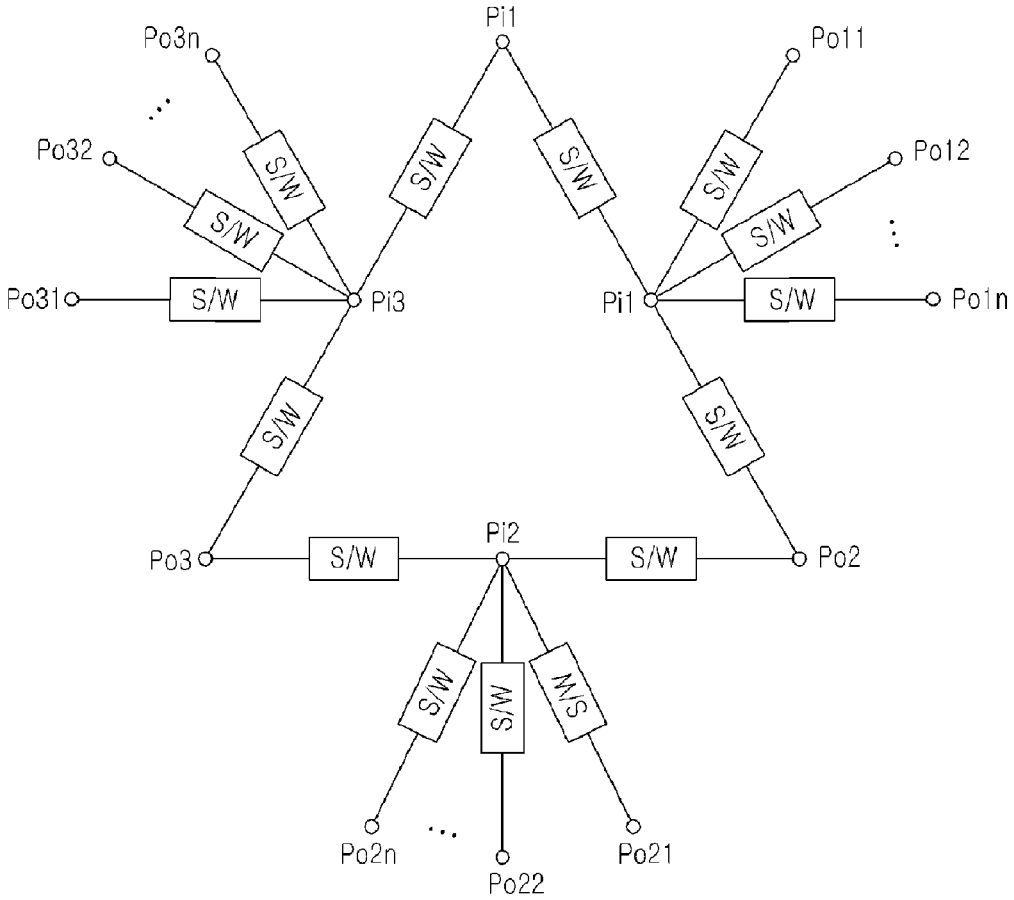
FIG. 13 illustrates a schematic diagram supplemented with N output ports.

Up to N output ports can be supplemented at each input port as illustrated in FIG. 13.

Figure 14:
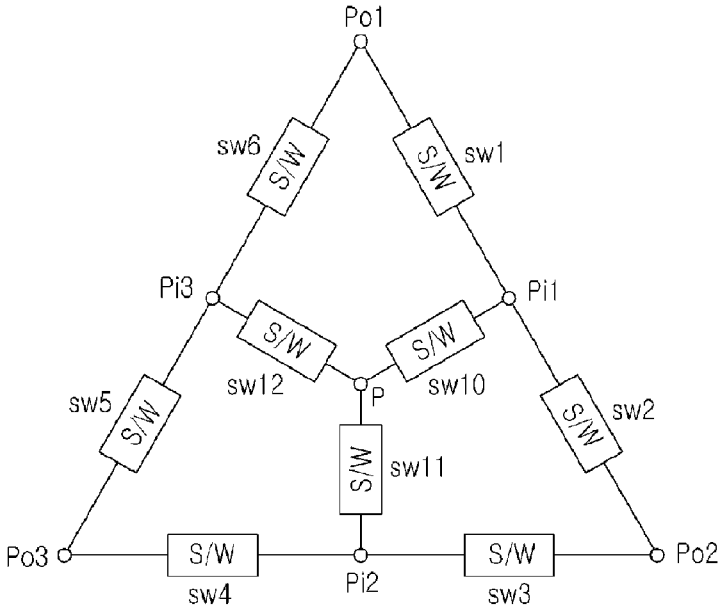
FIG. 14 is a schematic diagram depicts the connection status of a redundancy port according to a fourth embodiment of the present invention.

FIG. 14 depicts a schematic diagram according to a fourth embodiment of the present invention, As illustrated, it comprises 3 input ports (Pi1, Pi2, Pi3) for receiving 3 incoming signals, 3 output ports (Po1, Po2, Po3), 6 switches (sw1~sw6) for alternately connecting the 3 input ports to the 3 output ports as a circulating configuration, a redundancy port (P), and switches (sw10, sw11, and sw12) for connecting the redundancy port (P) to the input ports (Pi1, Pi2 and Pi3).

The switches are controlled by switching control signals of a controller (not shown).

An operation will be described below.

In normal operation, the $10^{th}$, $11^{th}$ and $12^{th}$ switches (sw10, sw11, and sw12) are always off.

In case of a failure at any of the $1^{st}$, $2^{nd}$ and $3^{rd}$ output ports (Po1, Po2, and Po3), the redundancy port (P) replaces the failure output port.

For example, when a $3^{rd}$ incoming signal (s3) at the $3^{rd}$ input port (Pi3) is to be divided and sent out into the $1^{st}$ and $3^{rd}$ output ports (Po1, Po3), and a $2^{nd}$ incoming signal (s2) at the $2^{nd}$ input port (Pi2) is to be sent out into the output port (Po2), the $3^{rd}$ output port is failed.

The normal operation is performed in the same manner as in the third embodiment. When the $3^{rd}$ output port is failed, the $5^{th}$ switch (sw5) is off and the $12^{th}$ switch (sw12) is on. Therefore, the redundancy port (P) runs as the $3^{rd}$ output port (Po3). The incoming signal at the $3^{rd}$ input port is divided and sent out into the $1^{st}$ output port (Po1) and the redundancy port (P).

In accordance with the fourth embodiment, in case of a failure of any of the output ports, the disconnection of outgoing signals is prevented by replacing the failed output port with the redundancy port.

In addition, the above redundancy port is not limited to the usage of replacement of the failed output port and can be used as a supplemental output port.

Figure 15:
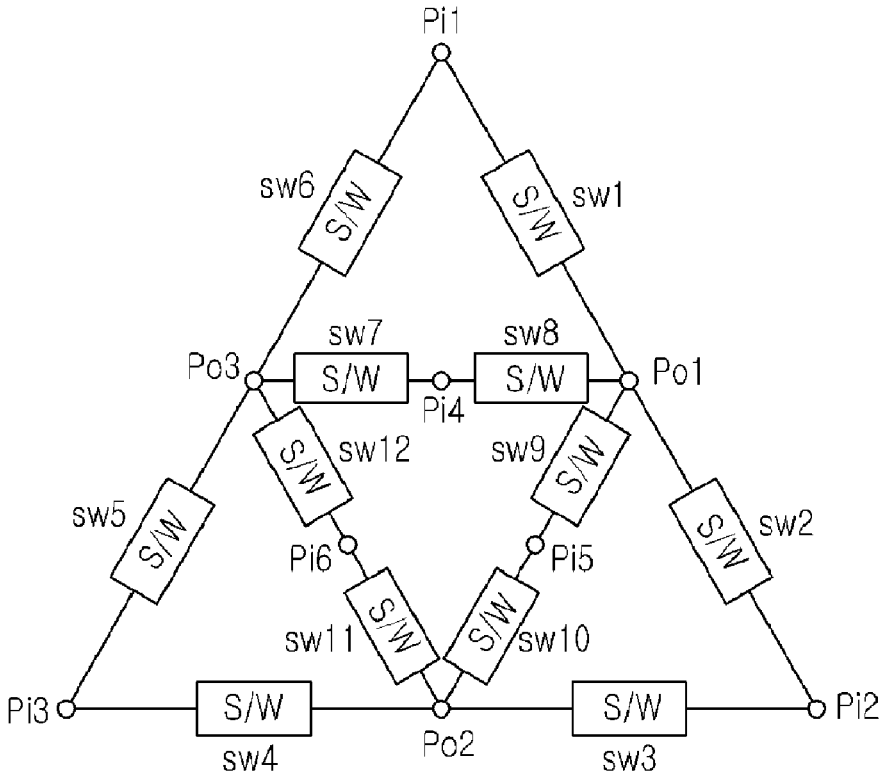
FIG. 15 depicts a schematic diagram according to a fifth embodiment of the present invention.

FIG. 15 depicts a schematic diagram according to a fifth embodiment of the present invention. $4^{th}$, $5^{th}$ and $6^{th}$ input ports (Pi4, Pi5 and Pi6) are added to the structure illustrated in FIG. 1. These input ports each are so configured as to be connected commonly between two appropriate output ports by switching of $7^{th}$ to $12^{th}$ switches (SW7 to SW12).

Specifically, the $4^{th}$ input port (Pi4) has one end connected to the $3^{rd}$ output port (Po3) by the $7^{th}$ switch (SW7) and the other end connected to the $1^{st}$ output port (Po1) by the $8^{th}$ switch (SW8).

The $5^{th}$ input port (Pi5) has one end connected to the $1^{st}$ output port (Po1) by the $9^{th}$ switch (SW9) and the other end connected to the $2^{rd}$ output port (Po2) by the $10^{th}$ switch (SW10).

The $6^{th}$ input port (Pi6) has one end connected to the $2^{nd}$ output port (Po2) by the $11^{th}$ switch (SW11) and the other end connected to the $3^{rd}$ output port (Po3) by the $12^{th}$ switch (SW12).

In accordance with the fifth embodiment, an incoming signal at each of the added $4^{th}$, $5^{st}$, and $6^{th}$ input ports (Pi4, Pi5 and Pi6} is selectively sent out into one of at least two output ports.

In the above configuration, up to n input ports can be supplemented together with n witches at each of the $4^{th}$, $5^{th}$ and $6^{th}$ input ports (Pi4, Pi5 and Pi6) in a similar manner to that shown in FIG. 6.

Figure 16:
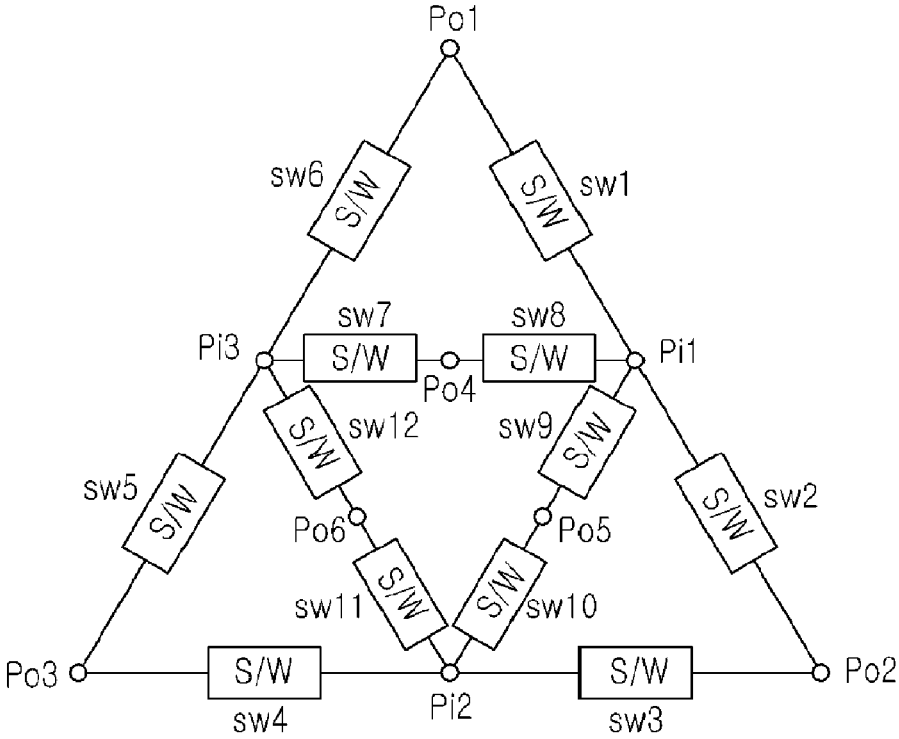
FIG. 16 depicts a schematic diagram according to a sixth embodiment of the present invention.

FIG. 16 depicts a schematic diagram according to a sixth embodiment of the present invention. $4^{th}$, $5^{th}$ and $6^{th}$ output ports (Po4, Po5 and Po6) are added to the structure illustrated in FIG. 8. These output ports each are so configured as to be connected commonly between two appropriate input ports by switching of the $7^{th}$ to $12^{th}$ switches (SW7 to SW12).

Specifically, the $4^{th}$ output port (Po4) has one end connected to the $3^{rd}$ input port (Pi3) by the $7^{th}$ switch (SW7) and the other end connected to the $1^{st}$ input port (Pi1) by the $8^{th}$ switch (SW8).

The $5^{th}$ output port (Po5) has one end connected to the $1^{st}$ input port (Pi1) by the $9^{th}$ switch (SW9) and the other end connected to the $2^{rd}$ input port (Pi2) by the $10^{th}$ switch (SW10).

The $6^{th}$ output port (Po6) has one end connected to the $2^{nd}$ input port (Pi2) by the $11^{th}$ switch (SW11) and the other end connected to the $3^{rd}$ output port (Pi3) by the $12^{th}$ switch (SW12).

In accordance with the sixth embodiment, an incoming signal at each of the $1^{st}$, $2^{nd}$ and $3^{rd}$ input ports (Pi1, Pi2 and Pi3) is appropriately distributed to the $4^{th}$ and $5^{th}$ output ports (Po4 and Po5), the $5^{th}$ and $6^{th}$ output ports (Po5 and Po6), or the $4^{th}$ and $6^{th}$ output ports (Po4 and Po6).

In the above configuration, up to n output ports can be supplemented together with n witches at each of the $4^{th}$, $5^{th}$ and $6^{th}$ output ports (Po4, Po5 and Po6) in a similar manner to that shown in FIG. 13.

As described above in detail, the switchable combiner/divider with multiple inputs/outputs according to the present invention sets the direction of output selectively depending on the switching status, in the case where it receives M incoming signals and then sends out N outgoing signals by combining and dividing them.

Also, the switchable combine/divider with multiple inputs/outputs is simple in structure, has less loss, and is small in size because of no unnecessary transmission line between ports.

Furthermore, the switchable combine/divider with multiple inputs/outputs can expand the number of incoming/outgoing signals to N.

The switchable combine/divider with multiple inputs/outputs prevents the disconnection of signal transmission by using a redundancy port, in case any input port is failed.

Figure 17:
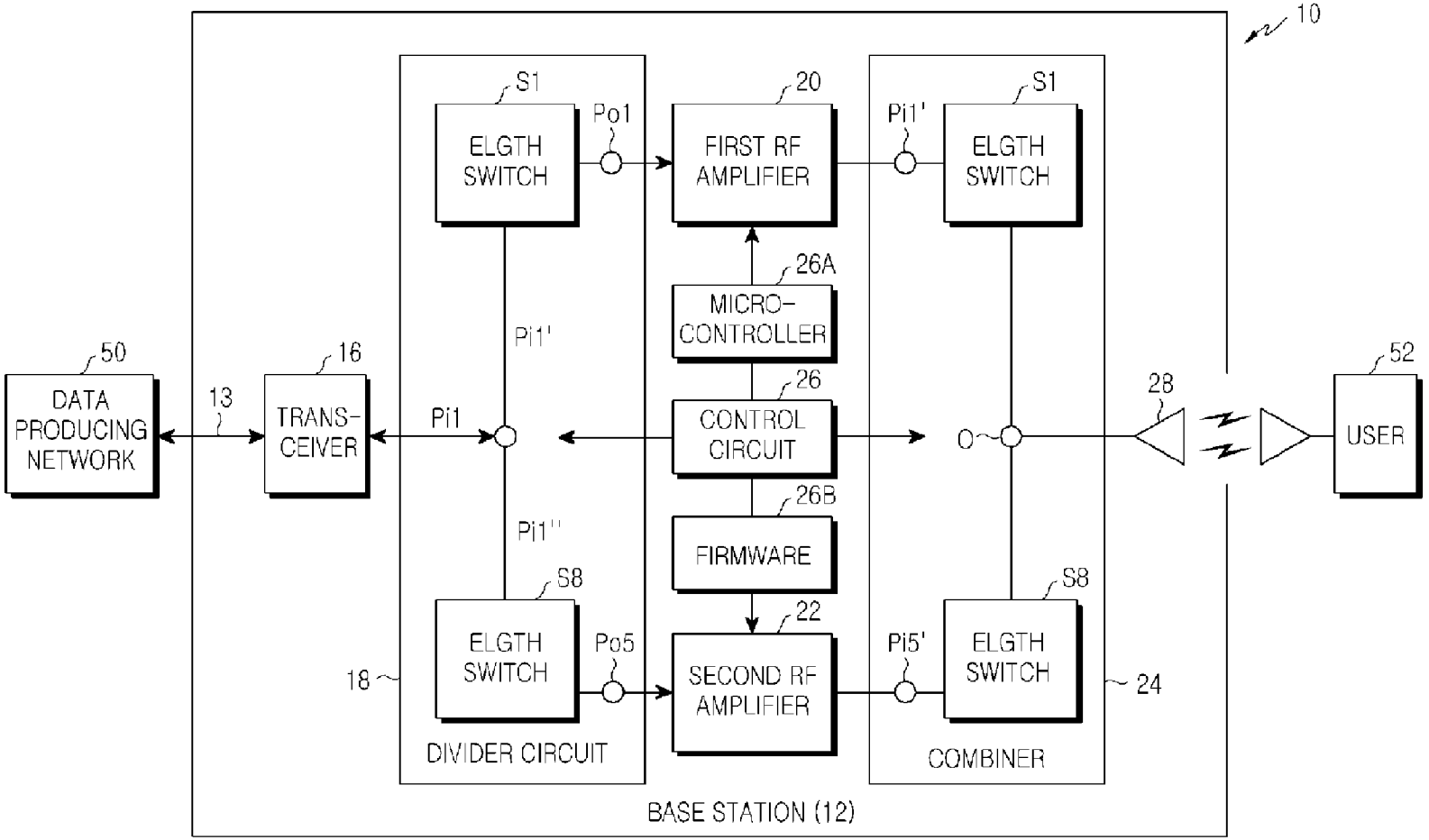
FIG. 17 depicts a switchable combiner and divider assembly in base station according to an embodiment of the present invention.

FIG. 17 depicts a switchable combiner and divider assembly 10 in base station according to an embodiment of the present invention. The data producing network 50, as shown in FIG. 17, has means for producing the data and applying the data either through remote technology or through a hardware source via a data signal 13. The signal 13 is applied to the transceiver 16 which has means for receiving and processing the data signal 13 and producing an input signal (Pi1) that is applied to the divider circuit 18.

The divider circuit 18 has circuit means for dividing the input signal (Pi1) into a first signal (Pi1') and second signal (Pi1"). The first signal (Pi1') is applied to a first switch (S1), and second signal (Pi1") is applied to an eighth switch (S8). When the first switch (S1) closes, an output signal (Po1) is produced; likewise, when the eighth switch (S8) closes, an output signal (Po5) is produced. The output signal (Po1) from the first switch (S1) is applied to a first RF amplifier 20 that is designed to produce an amplified input signal (Pi1'). The second RF amplifier 22 receives the output signal (Po5) from the eighth switch (S8) and produces an amplified input signal (Pi5')

The combiner circuit 24, as shown in FIG. 17, is also comprised of a first switch (S1) and eighth switch (S8). The first switch (S1) is applied the amplified input signal (Pi1'), and the eighth switch (S8) is applied the amplified input signal (Pi5'). When the two switches (S1, S8) close, the two signals (Pi1', Pi5') are combined by the combiner circuit 24 to produce an output signal (O). The output signal (O) is applied to the RF transmitting/receiving antenna 28 that transmits the output signal (O) into space.

The base station 12, as shown in FIG. 17, also includes a control circuit 26 that is comprised of a microcontroller 26A that is operated by firmware 26B. The control circuit 26 has means for selecting and controlling the operating sequence of the switches (S1 and S8) located in the divider circuit 18 and the switches (S1 and S8) located in the combiner circuit 24.

The switches and signals that are utilized in the switchable combiner and divider assembly 10 are located in a closed-loop series configuration, as shown in FIG. 4, FIG. 5, FIG. 11. and FIG. 12.

While the invention has been shown and described with reference to a certain preferred embodiment thereof, it will be understood by those skilled in the art that various changes in form and details may be made therein without departing from the spirit and scope of the invention as defined by the appended claims.

The invention claimed is:

1. A switchable combiner/divider with multiple inputs/outputs comprising:

multiple input ports for receiving multiple incoming signals;

multiple output ports;

a switching part for connecting the multiple input ports to the output ports alternately as a circulation configuration; and a controller for providing switching control signals to the switching part.

2. The switchable combiner/divider with multiple inputs/outputs of claim 1, further comprising:

n input ports; and n switches being supplemented between the n input ports and any of the output ports.

3. The switchable combiner/divider with multiple inputs/outputs of claim 1, further comprising:

n output ports; and n switches being supplemented between the n output ports and any of the input ports.

4. The switchable combiner/divider with multiple inputs/outputs of any of claims 1, 2 and 3, further comprising:

a redundancy port; and a $2^{nd}$ switching part supplemented between the redundancy port and the multiple output ports, for switching by a switching control signal received from the controller.

5. The switchable combiner/divider with multiple inputs/outputs of any of claims 1, 2 and 3, further comprising:

a redundancy port; and a $3^{rd}$ switching part being supplemented between the redundancy port and the multiple input ports, for switching by a switching control signal received from the controller.

6. The switchable combiner/divider with multiple inputs/outputs of any of claims 1, 2 and 3, further comprising:

a plurality of additional input ports; and an additional switching part supplemented between one end of each of the additional input ports and one of predetermined output ports among the plurality of output ports and between the other end of the each additional input and the other output port, for switching by a switching control signal received from the controller.

7. A switchable combiner with multiple inputs/outputs comprising:

$1^{st}$, $2^{nd}$ and $3^{rd}$ input ports for receiving 3 incoming signals;

$1^{st}$, $2^{nd}$ and $3^{rd}$ output ports;

$1^{st}$ to $6^{th}$ switches for connecting the $1^{st}$, $2^{nd}$ and $3^{rd}$ input ports to the $1^{st}$, $2^{nd}$ and $3^{rd}$ output ports alternately as a circulating configuration; and a controller for providing switching control signals to the switches.

8. The switchable combiner with multiple inputs/outputs of claim 7, further comprising:

a $4^{th}$ input port; and a $7^{th}$ switch being supplemented between any of the $1^{st}$, $2^{nd}$ and $3^{rd}$ output ports and the $4^{th}$ input port.

9. The switchable combiner with multiple inputs/outputs of claim 8, further comprising:

a $5^{th}$ input port; and an $8^{th}$ switch being supplemented between any of the $1^{st}$, $2^{nd}$ and $3^{rd}$ output ports and the $5^{th}$ input port.

10. The switchable combiner with multiple inputs/outputs of claim 9, further comprising:

a $6^{th}$ input port; and a $9^{th}$ switch being supplemented between any of the $1^{st}$, $2^{nd}$ and $3^{rd}$ output ports and the $6^{th}$ input port.

11. The switchable combiner with multiple inputs/outputs of claim 7, further comprising:

n input ports; and n switches being supplemented between any of the $1^{st}$, $2^{nd}$ and $3^{rd}$ output ports and the n input ports.

12. The switchable combiner with multiple inputs/outputs of any of claims 7 to 11, further comprising:

a redundancy port; and switches being supplemented between the redundancy port and the $1^{st}$, $2^{nd}$ and $3^{rd}$ output ports.

13. The switchable combiner/divider with multiple inputs/outputs of any of claims 7 to 11, further comprising:

$1^{st}$, $2^{nd}$ and $3^{rd}$ additional input ports; and an additional switching part for switching the $1^{st}$ additional input port to the $1^{st}$ output port or the $3^{rd}$ output port, and/or switching the $2^{nd}$ additional input port to the $1^{st}$ output port or the $2^{nd}$ output port, and/or switching the $3^{rd}$ additional input port to the $2^{nd}$ output port or the $3^{rd}$ output port by a switching control signal received from the controller.

14. A switchable divider with multiple inputs/outputs comprising:

$1^{st}$, $2^{nd}$ and $3^{rd}$ input ports for receiving 3 input signals;

$1^{st}$, $2^{nd}$ and $3^{rd}$ output ports;

$1^{st}$ to $6^{th}$ switches for connecting the $1^{st}$, $2^{nd}$ and $3^{rd}$ input ports to the $1^{st}$, $2^{nd}$ and $3^{rd}$ output ports alternately as a circulating configuration; and a controller for providing switching control signals to the switches.

15. The switchable divider with multiple inputs/outputs of claim 14, further comprising:

a $4^{th}$ output port; and a $7^{th}$ switch being supplemented between any of the $1^{st}$, $2^{nd}$ and $3^{rd}$ input ports and the $4^{th}$ output port.

16. The switchable divider with multiple inputs/outputs of claim 15, further comprising:

a $5^{th}$ output port; and an $8^{th}$ switch being supplemented between any of the $1^{st}$, $2^{nd}$ and $3^{rd}$ input ports and the $5^{th}$ output port.

17. The switchable divider with multiple inputs/outputs of claim 16, further comprising:

a $6^{th}$ output port; and a $9^{th}$ switch being supplemented between any of the $1^{st}$, $2^{nd}$ and $3^{rd}$ input ports and the $6^{th}$ output port.

18. The switchable divider with multiple inputs/outputs of claim 14, further comprising:

n output ports; and n switches being supplemented between any of the $1^{st}$, $2^{nd}$ and $3^{rd}$ input ports and the n output ports.

19. The switchable divider with multiple inputs/outputs of claim 14 or 18, further comprising:

a redundancy port; and switches being supplemented between the redundancy port and the $1^{st}$, $2^{nd}$ and $3^{rd}$ input ports.

20. The switchable combiner/divider with multiple inputs/outputs of any of claims 14 to 18, further comprising:

$1^{st}$, $2^{nd}$ and $3^{rd}$ additional output ports; and an additional switching part for switching the $1^{st}$ additional output port to the $1^{st}$ input port or the $3^{rd}$ input port, and/or switching the $2^{rd}$ additional output port to the $1^{st}$ input port or the $2^{nd}$ input port, and/or switching the $3^{rd}$ additional output port to the $2^{rd}$ input port or the $3^{rd}$ input port by a switching control signal received from the controller.

* * * * *